US007497720B2

(12) United States Patent
Kathan et al.

(10) Patent No.: US 7,497,720 B2
(45) Date of Patent: Mar. 3, 2009

(54) HOUSING FOR CONNECTION TO AN ELECTRICAL LINE

(75) Inventors: Hugo Kathan, Kressbronn (DE); Thomas Roehm, Constance (DE); Marcus Will, Neu-Ulm (DE)

(73) Assignee: i f m electronic gmbh, Essen (DE)

( * ) Notice: Subject to any disclaimer, the term of this patent is extended or adjusted under 35 U.S.C. 154(b) by 0 days.

(21) Appl. No.: 11/564,103

(22) Filed: Nov. 28, 2006

(65) Prior Publication Data

US 2007/0155221 A1 Jul. 5, 2007

Related U.S. Application Data

(63) Continuation-in-part of application No. 11/428,583, filed on Jul. 5, 2006, now abandoned.

(30) Foreign Application Priority Data

Jul. 5, 2005 (DE) ..... 10 2005 031 708

(51) Int. Cl.
*H01R 4/24* (2006.01)

(52) U.S. Cl. ..... 439/404; 439/417

(58) Field of Classification Search ..... 439/404–417, 439/157

See application file for complete search history.

(56) References Cited

U.S. PATENT DOCUMENTS 5,722,852 A * 3/1998 Miek ..... 439/417
6,123,585 A * 9/2000 Hussong et al. ..... 439/652
6,648,672 B1 * 11/2003 Meinke ..... 439/422
6,721,184 B1 * 4/2004 Lehmeier et al. ..... 361/728
6,827,600 B2 * 12/2004 Negishi et al. ..... 439/404

FOREIGN PATENT DOCUMENTS

DE 4307896 C2 9/1994
DE 19537684 A1 4/1997
DE 19756167 C2 7/1999

OTHER PUBLICATIONS

IFM Electronic GMBH: Communication Systems, Catalog 2005, pp. 116FF.

* cited by examiner

*Primary Examiner*—Truc T Nguyen
*Assistant Examiner*—Xuong M Chung-Trans
(74) *Attorney, Agent, or Firm*—David S. Safran; Roberts Mlotkowski Safran & Cole, P.C.

(57) ABSTRACT

A housing for connection to an electrical line (14), especially a bus line, with at least one first housing part (2*a*) and one second housing part (2*b*), with at least one locking system 6 for locking the first housing part (2*a*) with the second housing part (2*b*) in a common locking position, whereby a contact device (15) for making electrical contact with the line (14) is assigned to the first housing part (2*a*) and whereby at least one line bed (16) for guiding the line (14) is formed in the second housing part (2*b*). The line bed (16) is made—at least partially—in a line bed carrier (17), and the contact device (15) and the line bed carrier (17) can be turned such that the orientation of the line path can be adjusted with respect to the housing (2).

13 Claims, 7 Drawing Sheets

HOUSING FOR CONNECTION TO AN ELECTRICAL LINE

CROSS-REFERENCE TO RELATED APPLICATION

This application is a continuation-in-part of commonly owned, co-pending U.S. patent application Ser. No. 11/428,583, filed Jul. 5, 2006.

BACKGROUND OF THE INVENTION

1. Field of the Invention

The invention relates to a housing for connection to an electrical line, especially a bus line, with at least a first housing part and a second housing part, with at least a locking system for locking the first housing part to the second housing part in a common locking position, a contact device for making electrical contact with the line being assigned to the first housing part and at least a line bed for guiding the electrical line being formed in the second housing part.

2. Description of Related Art

Housings of the type under consideration have been known for a long time, for example, actuator/sensor interface modules that are used as described below, by way of example, for explaining the invention. The locking system under consideration here and the housing considered here are, however, in no way limited to this application. Actuator/sensor-interface modules are included in an actuator-sensor-interface (AS-interface) bus system, with which it is possible to connect actuators and sensors to the lowermost control plane—for example a SPS or a PC—via a bus line. Here, the AS-interface modules establish the connection between the bus line and the actuator or sensor.

Often, the housing of the AS-interface modules is divided into two parts. In the first housing part, there is programmable control logic that is parameterized, for example, with the address of the AS-interface module that manages the bus protocol and that forms the interface to the actuators or sensors that can be connected to the first housing part. The second housing part generally has only one mounting function; it is fixed in a first mounting step at the mounting site of the AS-interface module, for example by slipping it onto a top-hat rail or by screwing it onto the wall of a building or machine. The second housing part furthermore has a fixed line bed that is matched to the lines of the AS-interface bus with which contact is to be made.

In further mounting, the bus line is placed in the line bed of the second housing part and then the first housing part is seated on the second housing part and—as is known from the prior art—screwed to the second housing part (German Patent DE 197 56 167 C2; ifm electronic gmbh: "Communications Systems," Catalog 2005, pp. 116 ff).

It can be easily imagined that this type of mounting, depending on the application site, can be very difficult, unreliable or even impossible. On the one hand, the electrician needs both hands for mounting, one hand to hold the first housing part, the other hand for the screwing operation; on the other hand, poorly accessible mounting sites are problematic because not only must it be possible to accommodate the AS-interface module there, but in addition access to the mounting tool (screwdriver) must also be ensured.

Known from German Patent Application DE 195 37 684 A1 is a detachable connection for a multipart housing that does not require screwing operations and that uses the connection of the housing parts with a locking element that is provided on one side of the housing on which the housing parts are in contact with one another. Known from German Patent DE 43 07 396 C2 is another detachable locking system for a two-part housing without screwing operations, whereby the locking element is accessible from the top part of the housing. Neither of these two housings with locking systems provides a connection, made with the locking system of the housing parts, to an electrical line, however.

Moreover, it often makes mounting complicated in that the location of the lines with which contact is to be made does not agree with the orientation dictated by the fixed line bed, and thus unsightly loops and bends in the line path result.

SUMMARY OF THE INVENTION

Thus, a primary object of this invention is to avoid—at least to some extent—the indicated problems in the mounting of two-part or multipart housings.

The aforementioned object is achieved with a housing for connection to an electrical line in that the line bed is made—at least partially—in a line bed carrier and the contact device and the line bed carrier can be turned such that the orientation of the line path can be adjusted with respect to the housing. The housing according to the invention thus allows optimum matching of the orientation of the line bed to the path of the contact-making line—often dictated by boundary conditions. The housing according to the invention can be mounted at any time in the conventional mounting position, for example, vertically, so that inscriptions attached to the housing can be easily read and connections located in or on the housing always have a uniform alignment. At the same time, it is possible for the line with which contact is to be made to run into the line bed and thus into the housing and to be routed out of it in any orientation. The rotation capacity of the contact device and of the line bed in the sense of the invention is also defined as only certain—for example, latched—angular positions being adjustable or the contact device and/or the line bed carrier having to be pulled out of the first housing part and the second housing part for adjustment of its orientation, turned and inserted again into the respective housing parts.

According to another advantageous configuration of the invention, the contact device and the line bed carrier can only be turned in certain selected angular positions, especially into angular positions of 0°, 90°, 180° and 270°, the line bed in the 0° angular position running preferably parallel to one housing edge. For housings that are made square, the line bed consequently always runs in the indicated preferred angular positions roughly parallel to the housing edge.

According to another preferred configuration of the invention, the contact device and the line bed carrier have mechanical coding so that joining of the first housing part and the second housing part into the common locking position is only possible in corresponding angular positions, i.e., at each of four angular positions at which the contact device and the line bed carrier noted above. This measure makes it possible to prevent faulty contact-making due to deviating angular positions of the contact device and of the line bed carrier. This mechanical coding becomes especially important in particular in another preferred configuration of the invention in which the line bed in the line bed carrier is made to accommodate mechanically-encoded, asymmetrical flat lines. When using these flat lines, it is of decisive importance that the orientation of the contact device to the line bed carrier and the line supported in it is unambiguous so that the lines embedded in the flat line make contact in the correct orientation.

In another preferred configuration of the invention, the contact device has a contact element carrier and at least one contact element attached therein, the contact element making contact with the line routed in the line bed in the locking position of the housing in penetration technology. This means that the contact element penetrates the jacketing of the line routed in the line bed and then makes contact with the electrically conductive parts of the line. Based on this preferred configuration, one especially preferred configuration of the housing according to the invention has a locking system according to the first teaching of the invention, the locking system being made such that when the positioning element is pivoted into the locking position, the first housing part and the second housing part are moved translationally toward one another in the direction of the pivoting axis of the positioning element. In this case, the contact element essentially vertically penetrates the jacketing of the electrical line with which contact is to be made, with the special advantage that this penetration causes only comparatively little damage to the jacketing. For this reason, repeated contact-making of the same site or adjacent sites of the jacketing is possible without permanent damage to the line having to be feared.

The locking system for the two-part housing is preferably configured such that in the common locking position, a wall of the first housing part stands opposite to a wall of the second housing part, such that there is a pivotable positioning element with an actuating section, a fastening section that is connected to the actuating section, and a locking section that is connected to the fastening section, such that the positioning element with its fastening section can be attached to be able to pivot on or in the wall of the first housing part, such that the second housing part has a locking recess, and such that the positioning element in the locking position of the first housing part and of the second housing part with its locking section can be caused to engage the locking recess of the second housing part. Because the positioning element with its fastening section can be attached to be able to pivot on or in one wall of the first housing part, it is possible to connect the positioning element that is responsible for locking to the first housing part before mounting or in manufacture, so that mounting of the first housing part and locking of the first housing part to the second housing part are possible with one hand, by which mounting and locking are greatly simplified.

In another configuration, the locking system is made such that, when the positioning element is pivoted into the locking position, the first housing part and the second housing part are moved translationally toward one another in the direction of the pivoting axis of the positioning element. The pivoting motion of the positioning element is therefore converted into a lifting motion of the housing parts to be locked to one another, by which the first housing part and the second housing part can be reliably and reproducibly pressed against one another.

The fastening section of the positioning element preferably has a ring or a cylinder, and the locking section of the positioning element is formed by at least one projection of the positioning element assigned to the ring or the cylinder of the positioning element. Here, it is provided that the locking recess of the second housing part is made with a thread, a threaded section or a ramp and that the locking section of the positioning element that is made as a projection in the locking process can engage the thread, the threaded section or the ramp. Because the projections of the locking section are assigned to a ring or a cylinder of the fastening section, the locking action can be extended to areas of the two housing parts that are to be locked to one another, which areas are farther apart. Thus, the locking action is not only limited to an area in the vicinity of the pivoting axis, but it can also be distributed onto the edge area of the two housing parts that are to be locked to one another. In this connection, one especially preferred configuration of the locking system comprises the actuating section of the positioning element being made in the manner of a lever, by which with a comparatively low expenditure of force, major locking forces can be achieved when the positioning element is pivoted. This is especially advantageous when, with the locking system, the first housing part and the second housing part are to be moved toward one another in the manner of lifting, with a certain contact pressure.

According to another advantageous configuration, at least one fixing element is made in the actuating section of the positioning element, and the fixing element in the locking position can be engaged with the corresponding fixing elements on the first housing part and/or on the second housing part. Consequently, the fixing element forms another locking site for the first housing part and the second housing part. The additional locking action by the fixing element is especially effective when it engages both a corresponding fixing element on the first housing part and also a corresponding fixing element on the second housing part in the locking position. Another locking point—also away from the locking section of the positioning element—can be implemented by the fixing element.

In particular, there are now a number of possibilities for configuring and further developing the housing according to the invention. In this respect, reference is made, on the one hand, to the claims subordinate to claim 1, and, on the other hand, to the following description of an embodiment in conjunction with the drawings.

DETAILED DESCRIPTION OF THE INVENTION

Figure 1:
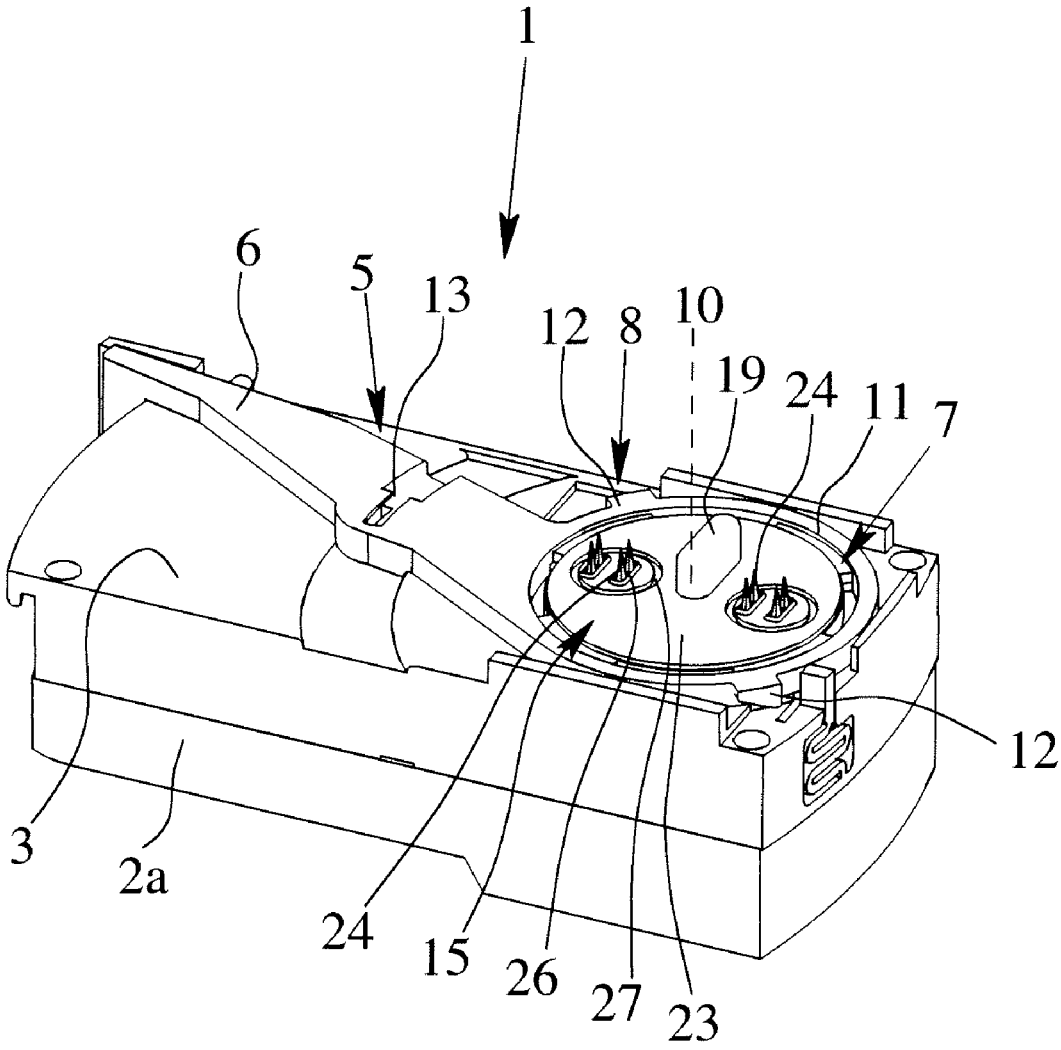
FIG. 1 is a perspective view of a preferred embodiment of a first housing part of the housing with a locking system according to the invention.

The housing according to the invention is described below based on a preferred embodiment of an actuator/sensor-interface module. The invention can also be described equally well based on other two-part or multipart housings. The housing according to the invention is completely independent of the special application and the electrical function of components that may be accommodated in the housing.

The housings or housing parts shown in FIGS. 1 to 6 are used to make contact with an electrical line 14 (FIGS. 2-4), in this case, an AS-interface bus line. To do this, the first housing part 2*a* has a contact device 15, and two line beds 16 are formed in the second housing part 2*b* for guiding the line 14.

The line beds 16 are made partially in a line bed carrier 17, and the contact device 15 and the line bed carrier 17 can be turned so that the path of the line can be adjusted with reference to the housing formed of housing parts 2*a*, 2*b*. The line beds 16 and the line bed carrier 17 can be seen especially well in FIGS. 5 & 6. In the embodiment shown in FIGS. 2 to 6, the line bed carrier 17 can be brought only into certain angular positions, in this case, into angular positions of 0°, 90°, 180°, and 270°. In this connection, the line bed in the 0° angular position runs parallel to a housing edge 18 of the second housing part 2*b*.

Basically, embodiments of a housing according to the invention that allow almost any angular positions of the lines 14 with which contact is to be made with respect to the housing parts 2*a*, 2*b* are also possible. The housing parts 2*a*, 2*b* according to the invention are also not limited to contact devices 15 and line bed carriers 17, which can be aligned only in four angular positions. With the embodiment according to FIG. 2, however, most installation problems can be solved very advantageously without the lines 14 with which contact is to be made having to be unnecessarily looped or run in some other deviating path in order to be able to thread them into the housing parts 2*a*, 2*b* in a suitable manner.

The contact device 15 and the line bed carrier 17, moreover, have mechanical coding that enables joining of the first housing part 2*a* and the second housing part 2*b* into the common locking position only in angular positions of the contact device 15 and of the line bed carrier 17 that correspond to one another. In the illustrated embodiment, the mechanical coding is implemented by a pin 19 on the contact device 15 and a recess 20 in the line bed carrier 17; the contact device 15 and the line bed carrier 17 must consequently be turned in the same direction in the first housing part 2*a* and the second housing part 2*b* so that both of the housing parts 2*a*, 2*b* can be joined together.

In the preferred embodiment according to FIGS. 1 to 4, the contact device 15 is radially and axially supported in the first housing part 2*a* and the line bed carrier 17 in the second housing part 2*b*. In particular, the contact device 15 and line bed carrier 17 can be axially snapped into the first housing part 2*a* and the second housing part 2*b* with comparative ease. Furthermore, the transition between the contact device 15 and the first housing part 2*a* is sealed with a gasket 21. This is especially advantageous when the housing formed of housing parts 2*a*, 2*b* is used in a very dirty or moist environment, in order to protect possibly sensitive electronics in the first housing part 2*a* from penetration of substances that endanger operation.

The line bed 16 shown in FIGS. 2 to 6 in the line bed carrier 17 is used to hold actuator/sensor interface lines that constitute mechanically-encoded asymmetrical flat lines 1. Line bed carriers 17 with two line beds 16 are always used for those AS-interface modules that require an external power supply. In this case, the illustrated line beds 16 are made essentially straight and running essentially parallel to one another in the line bed carrier 17.

The contact device 15 has a contact element carrier 23 and a contact element 24 attached therein, the contact element 24, in the locking position of the housing 2, making contact with the line 14 routed in the line bed 16 by penetration technology; this means that the contact element 24 penetrates a jacketing 25 of the electrical line 14 when the housing parts 2*a*, 2*b* are locked together, and thus, makes contact with the line 14.

Figure 2:
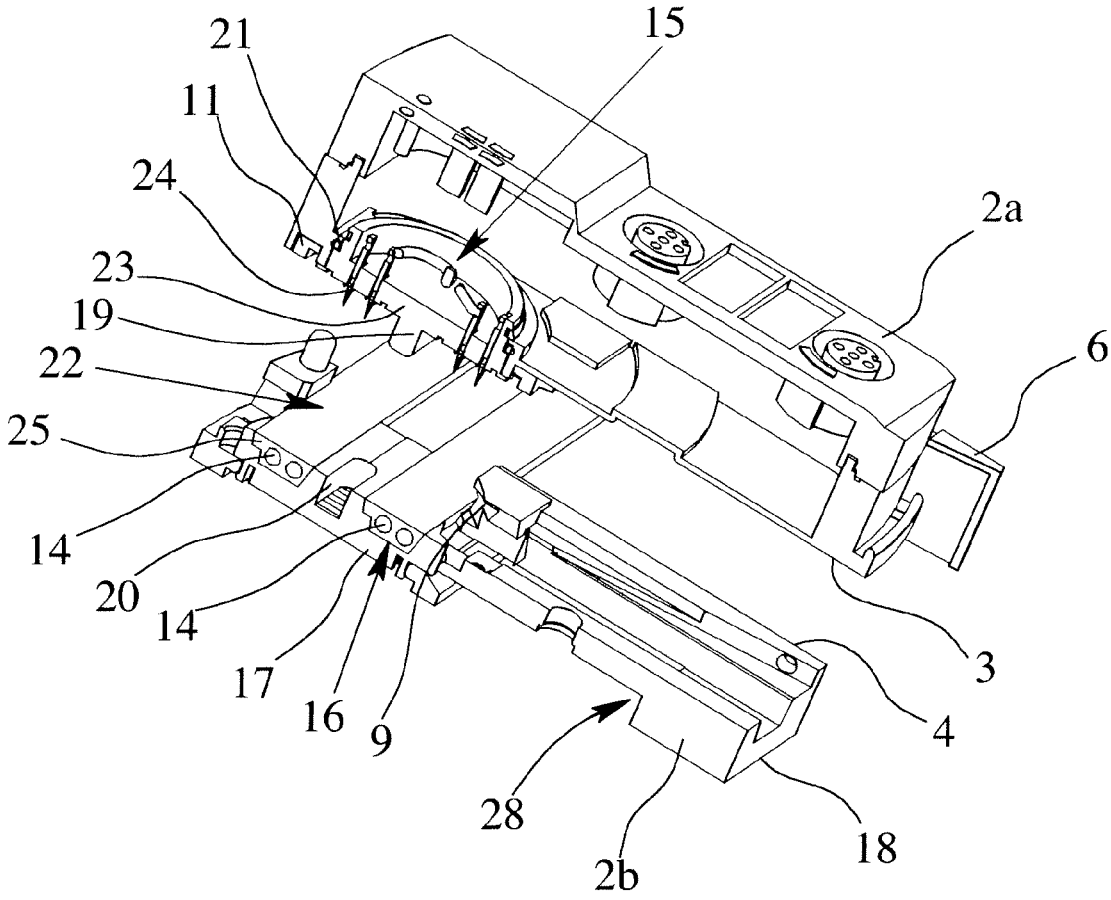
FIG. 2 is an exploded perspective sectional view of a preferred embodiment of the housing according to the invention seen obliquely from above.
Figure 3:
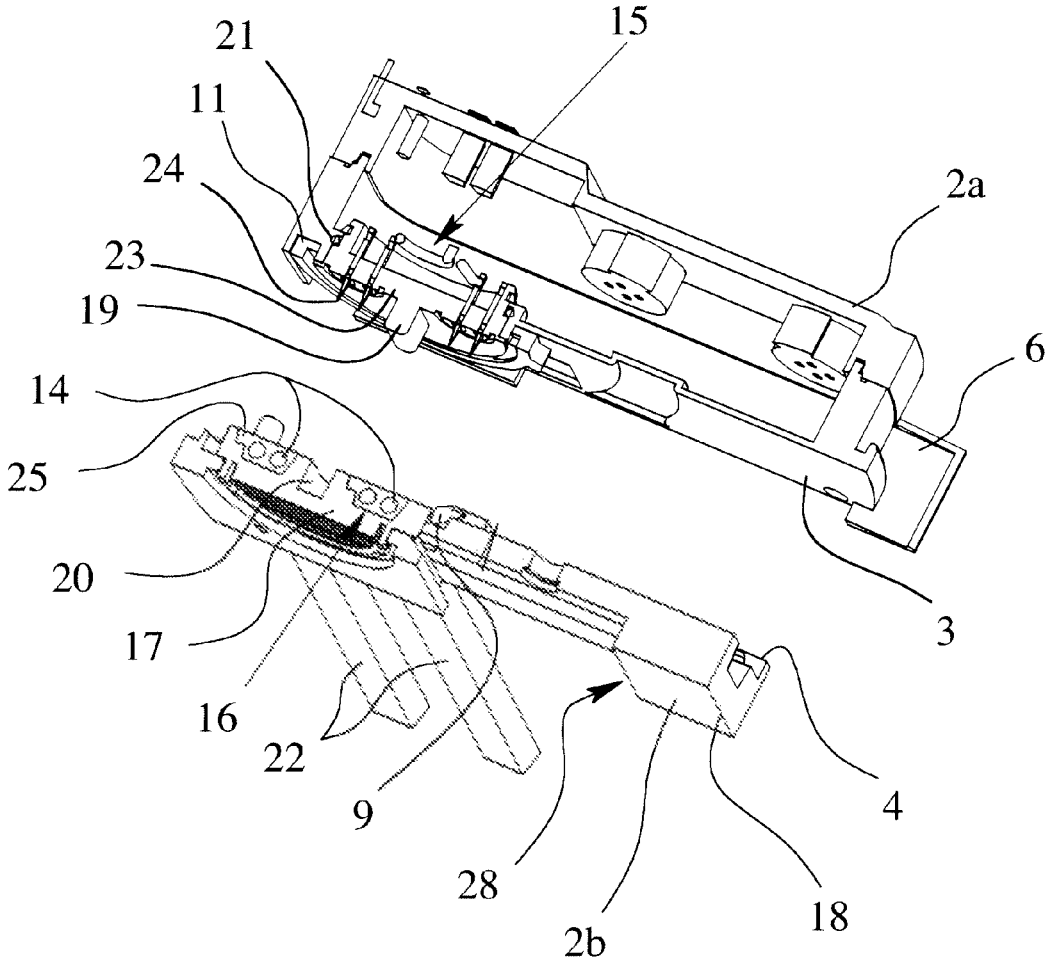
FIG. 3 is a view like that of FIG. 2 but showing the embodiment of the housing according to the invention obliquely from below.
Figure 4:
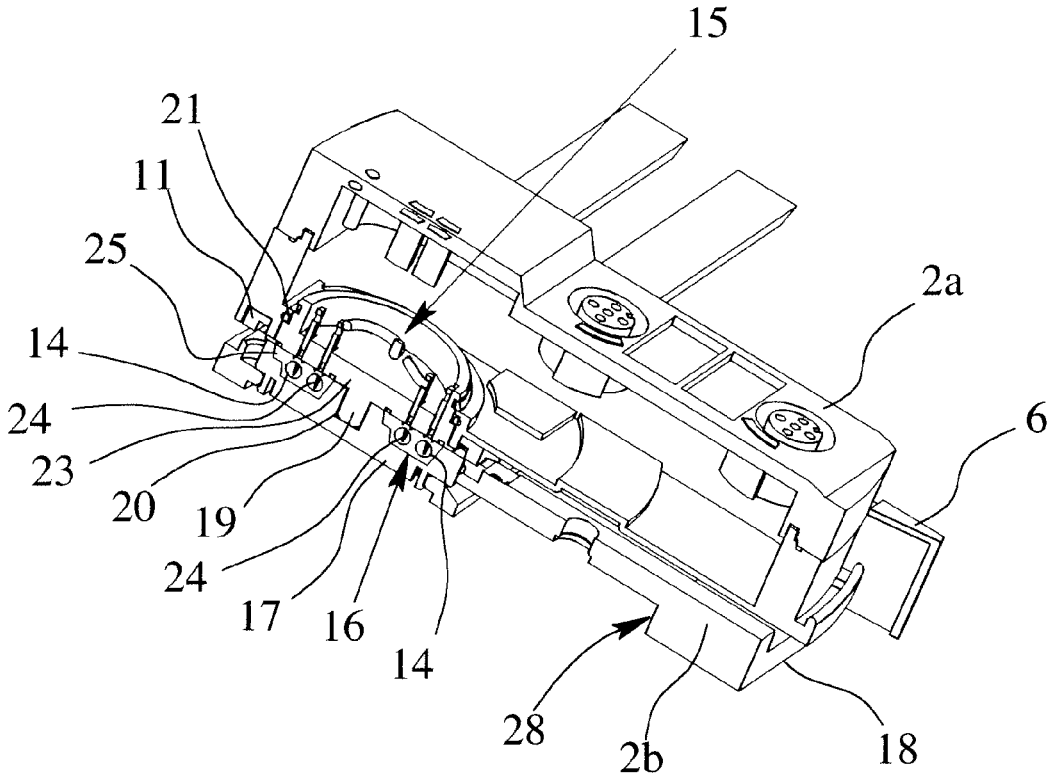
FIG. 4 is a perspective sectional view of the FIG. 2 embodiment of the housing according to the invention in the joined position of the housing.
Figure 5:
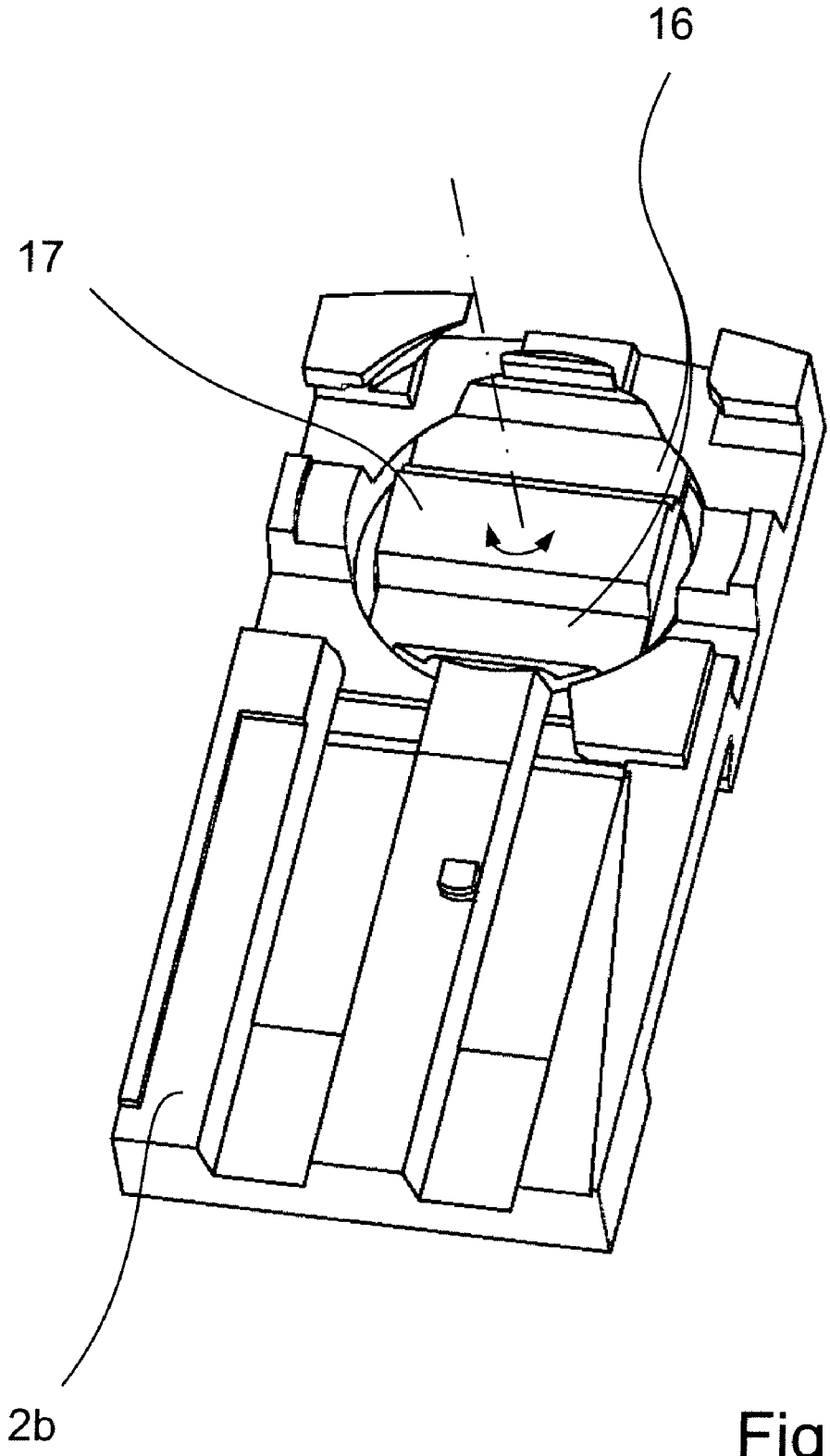
FIG. 5 is a perspective view of the second housing part with a line bed carrier of the preferred embodiment of the housing according to the invention.
Figure 6:
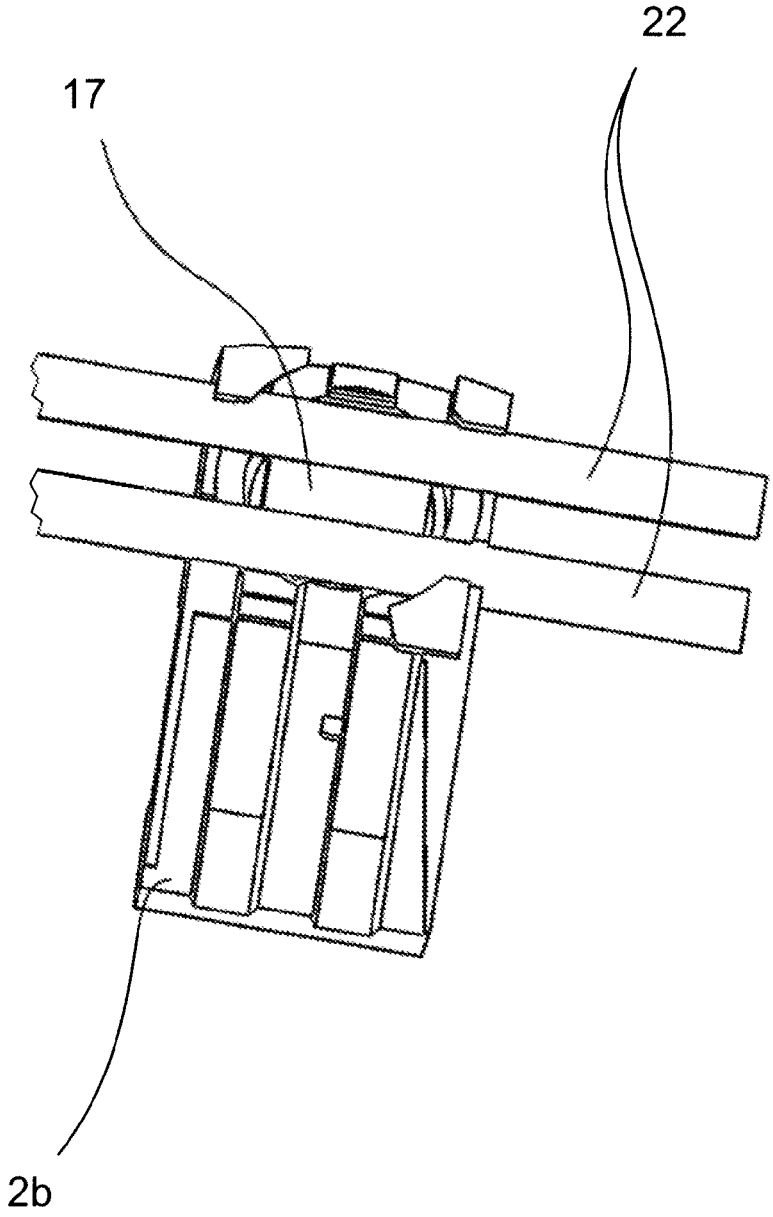
FIG. 6 is a perspective view of the second housing part shown in FIG. 5, but with an inserted flat line.
Figure 7:
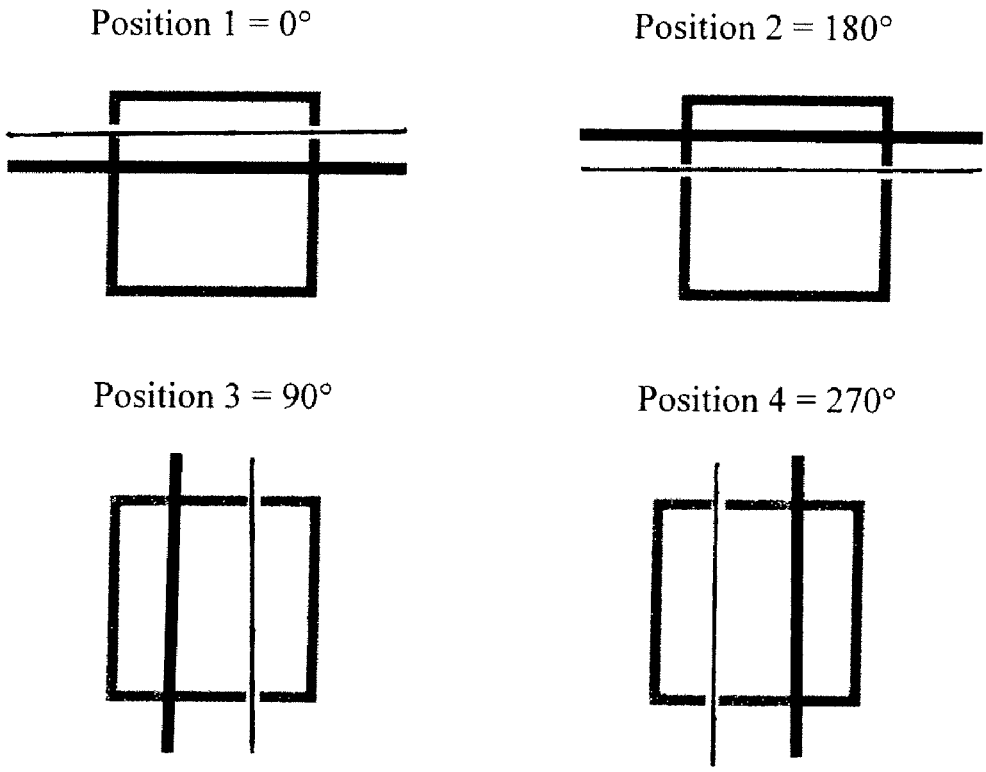
FIG. 7 is a diagram illustrating the four positions in which first housing part and the line bed carrier can be positioned relative to each other.

FIGS. 1 to 4 illustrate how the locking system 1 used with the housing parts 2*a*, 2*b* according to the invention works, whereby the housing 2 has a first housing part 2*a* and a second housing part 2*b*. As is shown in the figures, the first housing part 2*a*, itself, in turn, is formed of two parts; this is, however, immaterial to the explanation of this invention. FIGS. 2 to 4 show the basic orientation of the two housing parts 2*a* and 2*b* to be interlocked with one another, one wall 3 of the first housing part being opposite one wall 4 of the second housing part.

FIG. 1 shows in detail a positioning element 5 with an actuating section 6, a fastening section 7 that is connected to the actuating section 6, and a locking section 8 that is connected to the fastening section 7. The positioning element 5 is attached to one wall of the first housing part 2*a* to be able to pivot with its fastening section 7. The second housing part 2*b* has a locking recess 9 (FIGS. 2 & 3) in which the positioning element 5 with its locking section 8 can engage in the locking position of the first housing part 2*a* and of the second housing part 2*b*. The interplay of the locking section 8 of the positioning element 5 with the locking recess 9 of the second housing part 2*b* causes the locking of the first housing part 2*a* to the second housing part 2*b*.

FIG. 1 shows the locking position of the positioning element 5. The positioning element 5 can be pivoted around the pivoting axis 10 by the action of a force on the actuating section 6 of the positioning element 5.

According to FIG. 1, the fastening section 7 of the positioning element 5 has a ring 11, and the locking section 8 is formed by two projections 12 of the positioning element 5 that are assigned to the ring 11 of the positioning element 5. Corresponding thereto, the locking recesses 9 of the second housing part 2*b*, of which FIG. 2 shows only one locking recess 9, are made with a threaded section and a slightly curved ramp. This configuration results in that when the positioning element 5 is pivoted into the locking position, the first housing part 2*a* and the second housing part 2*b* are moved translationally toward one another in the direction of the pivoting axis 10 of the positioning element 5.

Therefore, this is especially advantageous because the first housing part 2*a* and the second housing part 2*b*, during locking, execute a controlled lifting motion with an end state that is then the pressing of the first housing part 2*a* and the second housing part 2*b* against one another.

By forming the locking section 8 with projections 12 at the periphery of the ring 11, a locking action is implemented relatively far away from the pivot axis 10 of the positioning element 5. FIG. 1 shows that the locking action is achieved by the projections 12 in interaction with the locking recesses 9, mainly in the edge and corner areas of the housing parts 2*a*, 2*b* that are to be locked to one another. The force to be expended for locking the two housing parts 2*a*, 2*b* is structurally reduced in the illustrated embodiment by a lever-like execution of the actuating section 6 of the positioning element 5.

Furthermore, in the actuating section 6 of the positioning element 5, a fixing element 13 is formed that engages with corresponding fixing elements on the first and second housing parts 2*a*, 2*b* in the locking position. The corresponding fixing element assigned to the first housing part 2*a* is hidden in the depiction according to FIG. 1 by the actuating section 6 of the positioning element 5. The additional fixing element 13 forms another locking point between the first housing part 2*a* and the second housing part 2*b*; this supports the reliability and loading capacity of the locking system 1.

The embodiment according to FIGS. 1 to 4 is advantageous in several respects. When the first housing part 2*a* is locked to the second housing part 2*b*, the first housing part 2*a* and the second housing part 2*b* are translationally moved toward one another in the direction of the pivot axis 10 of the positioning element 5 by pivoting the positioning element 5 into the locking position. In this way, the contact elements 24 are then also driven essentially vertically through the jacketing 25 of the electrical line 14 with which contact is to be made; this reduces damaging of the jacketing 25 to a minimum. For this reason, the AS-interface bus lines that have made contact with a housing and the pertinent locking system can also make contact repeatedly at the same location by penetration technology without the need to immediately fear destruction of the lines 14 with which contact has been made.

In order to reliably protect the lines 14 damaged by the contact elements 24 in the jacketing 25 against penetrating dirt and penetrating moisture, each of the pairs of contact elements 24 is surrounded by a peripheral seal 26 that is provided on the contact element carrier 23. In this case, the seal 26 is formed of a material from which the contact element carrier 23 is also formed. For further protection, in the illustrated embodiment, it is provided that a larger seal be used, in this case made from a softer material, which is designed to protect the combination of several contact elements 24 and the damage in the jacketing 25 caused by them against penetrating moisture. This protection is advantageously possible mainly in the use of flat lines 1 shown in FIGS. 2 to 4 and FIG. 6, since here peripheral seals made of soft seal material can rest completely on the flat line 1. The peripheral seal of softer material is not shown in FIG. 1, only a peripheral recess 27 that can hold the described peripheral seal being shown.

FIGS. 2 to 4 show that the second housing part 2*b* has a top-hat rail receiver 28 with which the second housing part 2*b* can be locked onto a top-hat rail. In another preferred embodiment—not shown here—the second housing part 2*b* is provided with several through holes for accommodating screws with which the second housing part 2*b* can be fixed at its mounting site.

Another advantage of the two-part housing with the locking system 1 shown in FIGS. 1 to 4 lies in the clearly simplified mounting of the housing formed of housing parts 2*a*, 2*b* and the clearly simplified—one-handed—locking of the first housing part 2*a* on the second housing part 2*b*.

What is claimed is:

1. Housing for connection to an electric line, comprising:

at least one first housing part, a second housing part, at least one locking system for locking the first housing part to the second housing part in a plurality of angular positions, a contact device for making electrical contact with the electric line being provided in the second housing part, and at least one line bed for guiding the electric line in the second housing part, wherein the at least one line bed is at least partially provided in a line bed carrier and wherein the contact device is mounted in the first housing part and the line bed carrier is mounted in the second housing part so that the orientation of the line path is adjustable with respect to the housing, wherein said at least one locking system locks the first housing part to the second housing part in a locking position in which a wall of the first housing part is opposite a wall of the second housing part, and wherein the at least one locking system comprises a pivotable positioning element with an actuating section, a fastening section which is connected to the actuating section and a locking section which is connected to the fastening section, wherein the positioning element with its fastening section is pivotably attachable to the wall of the first housing part, wherein the positioning element in a locking position of the first and second housing parts is engageable with its locking section in a locking recess of the second housing part.

2. Housing as claimed in claim 1, wherein the contact device is radially and axially supported in the first housing part.

3. Housing as claimed in claim 1, wherein a gasket is provided at a transition between the contact device and the first housing.

4. Housing as claimed in claim 1, wherein two essentially straight line beds which run essentially parallel to one another are provided in the line bed carrier.

5. Housing as claimed in claim 1, wherein the line bed in the line bed carrier is shaped to receive mechanically encoded, asymmetrical flat lines.

6. Housing as claimed in claim 1, wherein the second housing part has at least one fastening device for fastening the second housing part to a mounting wall and wherein the fastening device is one of a top-hat rail receiver and a through hole.

7. Housing as claimed in claim 1, wherein the contact device and the line bed carrier are lockable by said at least one locking system in only certain selected angular positions.

8. Housing as claimed in claim 7, wherein said angular positions are positions of 0°, 90°, 180° and 270°, and wherein the housing has at least one edge that is parallel to the line bed when the line bed the housing in the 0° angular position.

9. Housing as claimed in claim 7, wherein the contact device and the line bed carrier have a mechanical coding which enable joining of the first housing part and second housing part into the locking position only in said angular positions.

10. Housing as claimed in claim 9, wherein the mechanical coding comprises at least one of a pin and a recess on the contact device and the other of at least one of a pin and a recess on the line bed carrier.

11. Housing as claimed in claim 1, wherein the contact device has a contact element carrier and at least one contact element attached therein, the contact element being adapted to make contact with a line routed in the line bed in the locking position of the housing.

12. Housing as claimed in claim 11, wherein at least one contact element is surrounded by a peripheral seal which is provided on the contact element and wherein the seal rests on the line with which contact is to be made in the locking position of the housing.

13. Housing for connection to an electric line, comprising:

at least one first housing part, a second housing part, at least one locking system for locking the first housing part to the second housing part in a plurality of angular positions, a contact device for making electrical contact with the electric line being provided in the second housing part, and at least one line bed for guiding the electric line in the second housing part, wherein the at least one line bed is at least partially provided in a line bed carrier and wherein the contact device is mounted in the first housing part and the line bed carrier is mounted in the second housing part so that the orientation of the line path is adjustable with respect to the housing, wherein the contact device has a contact element carrier and at least one contact element attached therein, the contact element being adapted to make contact with a line routed in the line bed in the locking position of the housing, wherein the locking system comprises a pivotable positioning element with an actuating section, a fastening section which is connected to the actuating section and a locking section which is connected to the fastening section, wherein the positioning element with its fastening section is pivotably attachable to a wall of the first housing part, wherein the positioning element in the locking position is engageable with its locking section in a locking recess of the second housing part, wherein the positioning element, when it is pivoted into the locking position, is adapted to cause the first housing part and the second housing part to move translationally toward one another in a direction of a pivoting axis of the positioning element, and wherein the contact element penetrates a jacketing of the electric line essentially vertically when the first housing part and the second housing part are locked.

* * * * *